US009626925B2

(12) United States Patent
Cheng et al.

(10) Patent No.: US 9,626,925 B2
(45) Date of Patent: Apr. 18, 2017

(54) SOURCE DRIVER APPARATUS HAVING A DELAY CONTROL CIRCUIT AND OPERATING METHOD THEREOF

(71) Applicant: Novatek Microelectronics Corp., Hsinchu (TW)

(72) Inventors: Jhih-Siou Cheng, New Taipei (TW); Po-Hsiang Fang, Hsinchu (TW); Chieh-An Lin, Taipei (TW); Po-Yu Tseng, Taoyuan (TW); Ju-Lin Huang, Hsinchu County (TW); Yi-Chuan Liu, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 119 days.

(21) Appl. No.: 14/669,003

(22) Filed: Mar. 26, 2015

(65) Prior Publication Data

US 2016/0284297 A1 Sep. 29, 2016

(51) Int. Cl.
*G09G 3/36* (2006.01)

(52) U.S. Cl.
CPC ..... *G09G 3/3648* (2013.01); *G09G 3/3688* (2013.01); *G09G 3/3677* (2013.01); *G09G 2300/0413* (2013.01); *G09G 2310/08* (2013.01); *G09G 2320/0223* (2013.01)

(58) Field of Classification Search
CPC ..... G09G 3/3648
USPC ..... 345/99
See application file for complete search history.

(56) References Cited

U.S. PATENT DOCUMENTS 6,407,729 B1 * 6/2002 Moon ..... G09G 3/3648 345/205
2006/0089101 A1 * 4/2006 Kim ..... G09G 3/3688 455/62
2008/0238895 A1 10/2008 Lin et al.
2010/0315392 A1 * 12/2010 Sang ..... G09G 3/3648 345/205
2011/0316821 A1 12/2011 Suzuki et al.
2013/0141403 A1 6/2013 Shibuya
2014/0232713 A1 8/2014 Hsu et al.

FOREIGN PATENT DOCUMENTS

TW 200839710 10/2008
TW 201033963 9/2010
TW 201434017 9/2014

OTHER PUBLICATIONS

"Office Action of Taiwan Counterpart Application", issued on Nov. 9, 2016, p. 1-p. 8, in which the listed references were cited.

* cited by examiner

*Primary Examiner* — Long D Pham
(74) *Attorney, Agent, or Firm* — Jianq Chyun IP Office

(57) ABSTRACT

A source driver apparatus and an operating method thereof are provided. The source driver apparatus can drive a plurality of source lines of a display panel, wherein the display panel further comprising a gate driver apparatus. The source driver apparatus includes driving channels and a delay control circuit. The driving channels output source driving signals. The delay control circuit controls the driving channels to change delay times of the source driving signals within the same period, such that the delay times of the source driving signals respectively correspond to distances from the source lines to the gate driver apparatus.

17 Claims, 8 Drawing Sheets

SOURCE DRIVER APPARATUS HAVING A DELAY CONTROL CIRCUIT AND OPERATING METHOD THEREOF

BACKGROUND

Field of the Invention

The invention is related to a display apparatus and more particularly, to a source driver apparatus and an operating method thereof.

Description of Related Art

FIG. 1 is a schematic circuit block diagram illustrating a thin film transistor (TFT) liquid crystal display (LCD) 10. The LCD 10 includes a timing controller 11, one or more gate drivers (e.g., gate drivers 12_1 and 12_2 depicted in FIG. 1), one or more source drivers (e.g., source drivers 13_1, 13_2 and 13_3 depicted in FIG. 1) and a display panel 14.

The gate drivers 12_1 and 12_2 are coupled between the timing controller 11 and the display panel 14. After the gate drivers 12_1 and 12_2 receive a vertical start signal STV provided by the timing controller 11, the vertical start signal STV starts to be shifted gradually within the gate drivers 12_1 and 12_2 one by one according to a timing of a gate clock signal CPV. Thus, the gate drivers 12_1 and 12_2 alternately drive each gate line of the display panel 14 one by one according to the shifting positions of the vertical start signal STV. For instance, a gate line GD1 is first driven, then gate lines GD2 and GD3 are driven and so on. The timing controller 11 provides an output enable signal OE (or a disable signal) the gate drivers 12_1 and 12_2 through a control bus to control pulse widths of gate driving signals output by the gate drivers 12_1 and 12_2.

The source drivers 13_1, 13_2 and 13_3 are coupled between the timing controller 11 and the display panel 14. After the source drivers 13_1, 13_2 and 13_3 receive a horizontal start signal STH provided by the timing controller 11, the horizontal start signal STH is shifted gradually among the source drivers 13_1, 13_2 and 13_3 according to a timing of a source clock signal CK. The timing controller 11 outputs a plurality of line data (i.e., display data) in a string form to the data line bus DAT. Thus, the source drivers 13_1, 13_2 and 13_3 may obtain the display data from the data line bus DAT. The data line bus DAT is, for example, a bus complying with the mini low voltage differential signaling (mini-LVDS) standard. Based on the control of the source clock signal CK and the horizontal start signal STH output by the timing controller 11, the source drivers 13_1, 13_2 and 13_3 may latch different display data from the data line bus DAT in corresponding driving channels. Based on the control of a line latch signal LD, the source drivers 13_1, 13_2 and 13_3 may simultaneously convert the display data latched in the driving channels into source driving signals. According to a scanning timing of the gate drivers 12_1 and 12_2, the source driving signals may be written into a plurality of pixel units (e.g., pixel units P1, P2, P3, P4, P5, P6, P7, P8 and P9 depicted in FIG. 1) of the display panel 14 to display an image.

The display panel 14 is formed by two substrates, and a liquid crystal material (i.e., a LCD layer) is filled between the two substrates. The display panel 14 is configured with a plurality of source lines (or referred to as data lines, e.g., source lines SD1, SD2 and SD3 depicted in FIG. 1), a plurality of gate lines (or referred to as scan lines, e.g., the gate lines GD1, GD2 and GD3 depicted in FIG. 1) and a plurality of pixel units (e.g., the pixel units P1, P2, P3, P4, P5, P6, P7, P8 and P9 depicted in FIG. 1). The source lines SD1, SD2 and SD3 are vertical to the gate lines GD1, GD2 and GD3. The pixel units P1 through P9 are arranged in an array on the display panel 14. FIG. 1 illustrates an exemplary example of a circuit diagram of the pixel unit P3, and the other pixel units P1 through P2, P4 through P9 may be derived with reference to the circuit diagram of the pixel unit P3.

The gate drivers 12_1 and 12_2 outputs the gate driving signals to the gate lines GD1, GD2 and GD3. The gate driving signals cause transmission delay due to RC loads on the gate lines. FIG. 1 illustrates equivalent circuits of the gate lines GD1, GD2 and GD3, where resistor symbols are used to represent equivalent resistors (or parasitic resistors) on the gate lines, while capacitor symbols are used to represent equivalent capacitors (or parasitic capacitors) on the gate lines. The parasitic resistors and the parasitic capacitors gate lines form the RC loads which cause delay to signal transmission. As the size of the display panel 14 is increased, the delay effect of the gate lines become obvious, and a position with the maximum distance to the gate driver has the most serious delay effect.

FIG. 2 is a timing diagram illustrating the signals depicted in FIG. 1. With reference to FIG. 1 and FIG. 2, a pulse of the gate line GD2 starts to rise up after a pulse of the gate line GD1 ends. The RC load of the gate line GD1 causes the transmission delay, such that the gate driving signals GD1*a*, GD1*b* and GD1*c* received by the pixel units P1, P2 and P3 have different delay times. The gate driving signals GD1*a*, GD1*b* and GD1*c* and the delay times correspond to distances from the pixel units P1, P2 and the P3 to the gate driver 12_1. Similarly, the RC load of the gate line GD2 causes the transmission delay, such that the gate driving signals GD2*a*, GD2*b* and GD2*c* received by the pixel units P4, P5 and P6 have different delay times. The gate driving signals GD2*a*, GD2*b* and GD2*c* and the delay times correspond to distances from the pixel units P4, P5 and P6 to the gate driver apparatus 12_1.

In order to ensure all the pixel units of the previous gate line (e.g., the gate line GD1) are turned off) for the pixel units of the next gate line (e.g., the gate line GD2) to be turned on, the timing controller 11 may use an enable signal OE to narrow the pulse widths of the gate driving signals. Narrowing the pulse widths of the gate driving signals means shortening a charging time of a source driver charging the pixel units. However, a shortened charging time would lead to display abnormality due to the pixel units being insufficiently charged. This issue becomes worse in panels with larger sizes.

According to FIG. 2, for the same gate line GD2, the pixel unit P4 closer to the gate driver apparatus 12_1 obtains a greater effective charging time Tch1. An effective charging time Tch2 of the pixel unit P5 departing away from the gate driver apparatus 12_1 is smaller than the effective charging time Tch1 of the pixel unit P4, and an effective charging time Tch3 of the pixel unit P6 departing away from the gate driver apparatus 12_1 is further smaller than the effective charging time Tch2 of the pixel unit P5. As the effective charging time is shortened, the pixel units (e.g., the pixel unit P6 and/or pixel unit P5) departing away from the gate driver apparatus 12_1 would cause display abnormality due to the pixel units being insufficiently charged.

SUMMARY

The invention provides a source driver apparatus and an operating method thereof for increasing effective charging times of pixel units.

According to an embodiment of the invention, a source driver apparatus including a plurality of driving channels and a delay control circuit is provided. The source driver apparatus can drive a plurality of source lines of a display panel, wherein the display panel further comprising a gate driver apparatus. The driving channels output a plurality of source driving signals. The delay control circuit controls the driving channels to change delay times of the source driving signals within a period, such that the delay times of the source driving signals correspond to distances from the source lines to the gate driver apparatus.

According to an embodiment of the invention, an operating method of a source driver apparatus is provided. The operating method is used for driving a plurality of source lines of a display panel, wherein the display panel further comprises a gate driver apparatus. The operating method includes: outputting a plurality of source driving signals for driving the plurality of source lines; and configuring delay times of the source driving signals within a period, such that the delay times of the source driving signals correspond to distances from the source lines to the gate driver apparatus.

To sum up, in the source driver apparatus and the operating method thereof provided by the embodiments of the invention, the source driving signals output by different driving channels within the same horizontal scanning period have different delay times, so as to increase the effective charging times of the pixel units.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
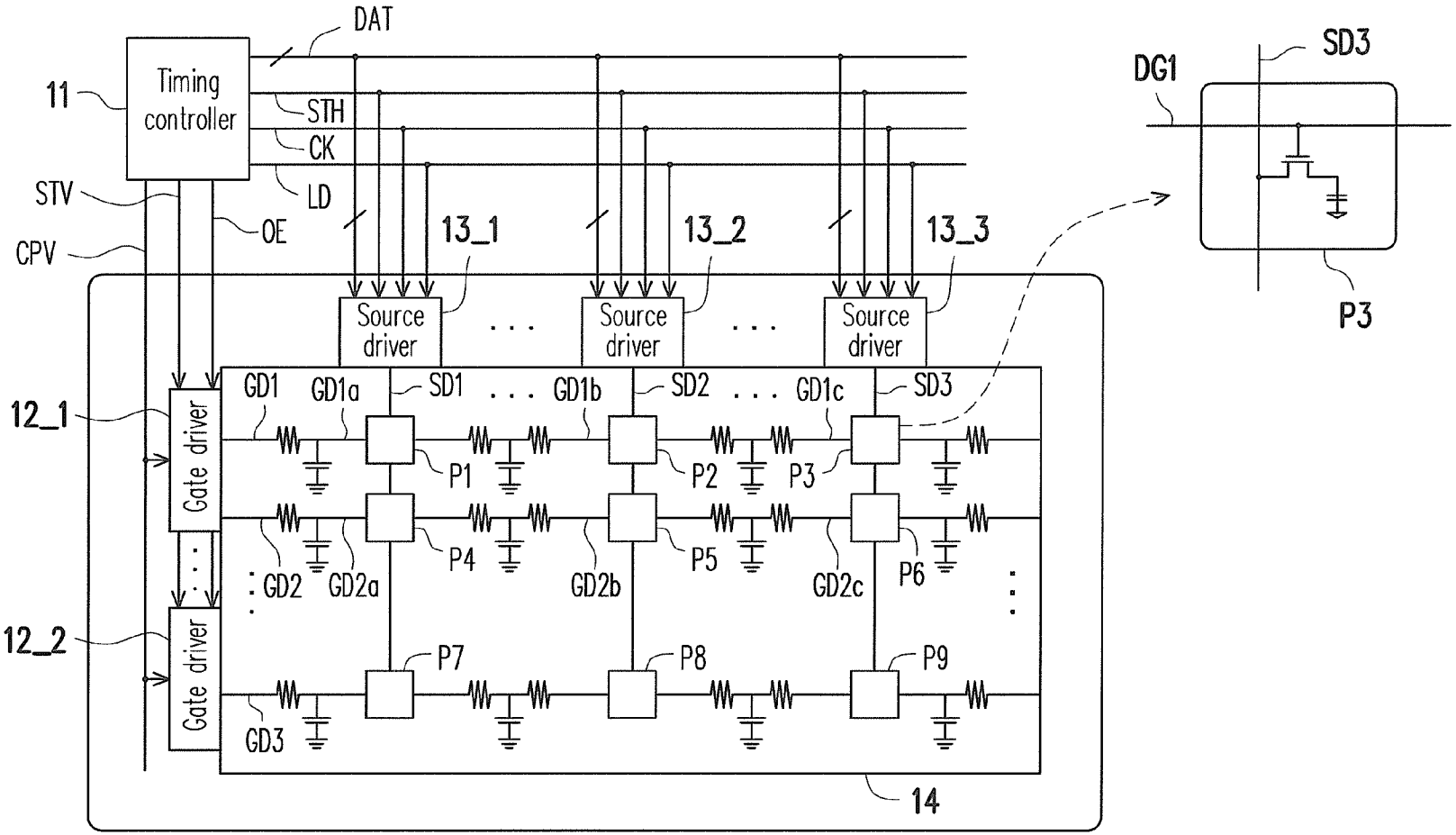
FIG. 1 (RELATED ART)
FIG. 1 is a schematic circuit block diagram illustrating a thin film transistor (TFT) liquid crystal display (LCD).

A term "couple" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

Figure 3:
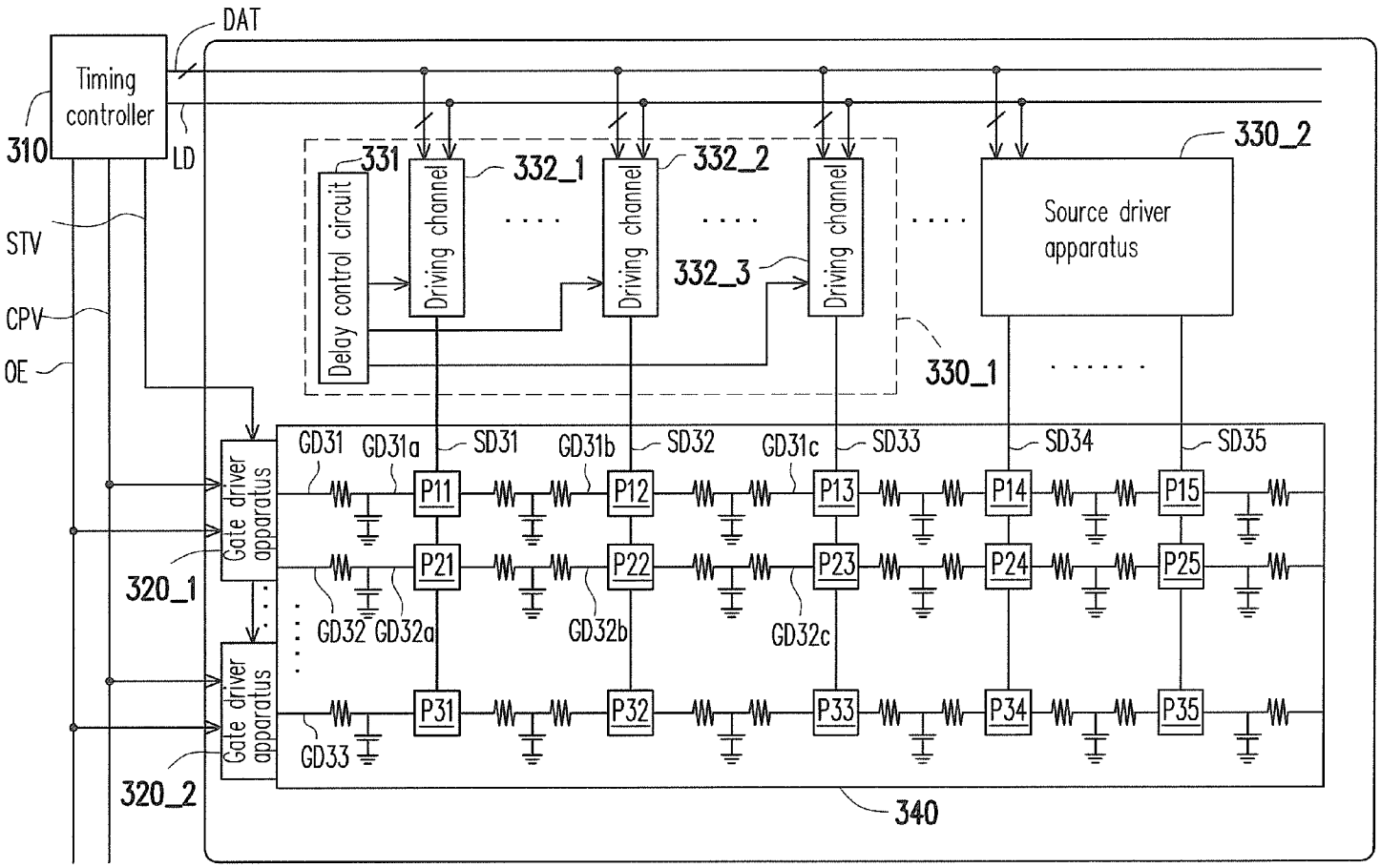
FIG. 3 is a schematic circuit block diagram illustrating a display apparatus according to an embodiment of the invention.

FIG. 3 is a schematic circuit block diagram illustrating a display apparatus 300 according to an embodiment of the invention. The display apparatus 300 may be a thin film transistor (TFT) liquid crystal display (LCD) or any other type of display apparatus. The display apparatus 300 includes a timing controller 310, one or more gate driver apparatuses (e.g., 320_1 and 320_2 depicted in FIG. 3), one or more source driver apparatuses (e.g., 330_1 and 330_2 depicted in FIG. 3) and a display panel 340. The gate driver apparatuses 320_1 and 320_2 may be different gate drivers or gate driver integrated circuits (ICs). The source driver apparatuses 330_1 and 330_2 may be different source drivers or source driver ICs. The timing controller 310, the gate driver apparatus 320_1, the gate driver apparatus 320_2 and the display panel 340 depicted in FIG. 3 may be derived with reference to the description related to the timing controller 11, the gate driver 12_1, the gate driver 12_2 and the display panel 14 depicted in FIG. 1.

The display panel 340 depicted in FIG. 3 is disposed with a plurality of source lines (also referred to as data lines, e.g., SD31, SD32, SD33, SD34 and SD35 depicted in FIG. 3), a plurality of gate lines (also referred to as scan lines, e.g., GD31, GD32 and GD33 depicted in FIG. 3) and a plurality of pixel units (e.g., P11, P12, P13, P14, P15, P21, P22, P23, P24, P25, P31, P32, P33, P34 and P35 depicted in FIG. 3). The gate lines GD31 through GD33, the source lines SD31 through SD35, the pixel units P11 through P15, the pixel units P21 through P25 and the pixel units P31 through P35 may be derived with reference to the description related to the gate lines GD1 through GD3, the source lines SD1 through SD3 and the pixel units P1 through P9 depicted in FIG. 1.

The gate driver apparatuses 320_1 and 320_2 are coupled between the timing controller 310 and the display panel 340. According to a trigger timing of a gate clock signal CPV, the gate driver apparatuses 320_1 and 320_2 shift the gate lines vertical to the start signal STV one by one from the first gate line to the last gate line. For example, the gate line GD31 is first driven, and then the other gate lines, i.e., GD32, GD33, and so on, are sequentially driven.

The source driver apparatus 330_1 will be described below as an example. The other source driver apparatuses (e.g., the source driver apparatus 330_2) may be derived with reference to the description related to the source driver apparatus 330_1.

The source driver apparatus 330_1 includes a delay control circuit 331 and a plurality of driving channels (e.g., driving channels 332_1, 332_2 and 332_3). The driving channels 332_1, 332_2 and 332_3 outputs a plurality of source driving signals to a plurality of source lines (e.g., source lines SD31, SD32 and SD33) of the display panel 340 in a one-to-one manner. For example, after the source driver 330_1 receives a horizontal start signal provided by the timing controller 310, the horizontal start signal is gradually shifted among the driving channels 332_1, 332_2 and 332_3 one by one according to a timing of the source clock signal. The timing controller 310 sequentially outputs display data in a string form to a data line bus DAT, and thereby, the driving channels 332_1, 332_2 and 332_3 may obtain the display data from the data line bus DAT. Based on the control of the source clock signal and the horizontal start signal output by the timing controller 310, the driving channels 332_1, 332_2 and 332_3 may latch the display data corresponding to the data line bus DAT. Based on the control of a line latch signal LD, the driving channels 332_1, 332_2 and 332_3 may convert the latched display data into the source driving signals. According to a scan timing of each of the gate driver apparatuses 320_1 and 320_2, the source driving signals may be written into the pixel units P11 through P15, P21 through P25 and P31 through P35 of the display panel 340 to display an image.

The delay control circuit 331 may control the driving channels 332_1, 332_2 and 332_3 to change a delay time of each of the source driving signals within the same horizontal scanning period. The delay time of each of the source driving signals corresponds to a distance from each of the source lines SD31, SD32 and SD33 to a gate driver apparatus (e.g., the gate driver apparatus 320_1 or 320_2), where the greater the distance, the longer the delay time.

Figure 4:
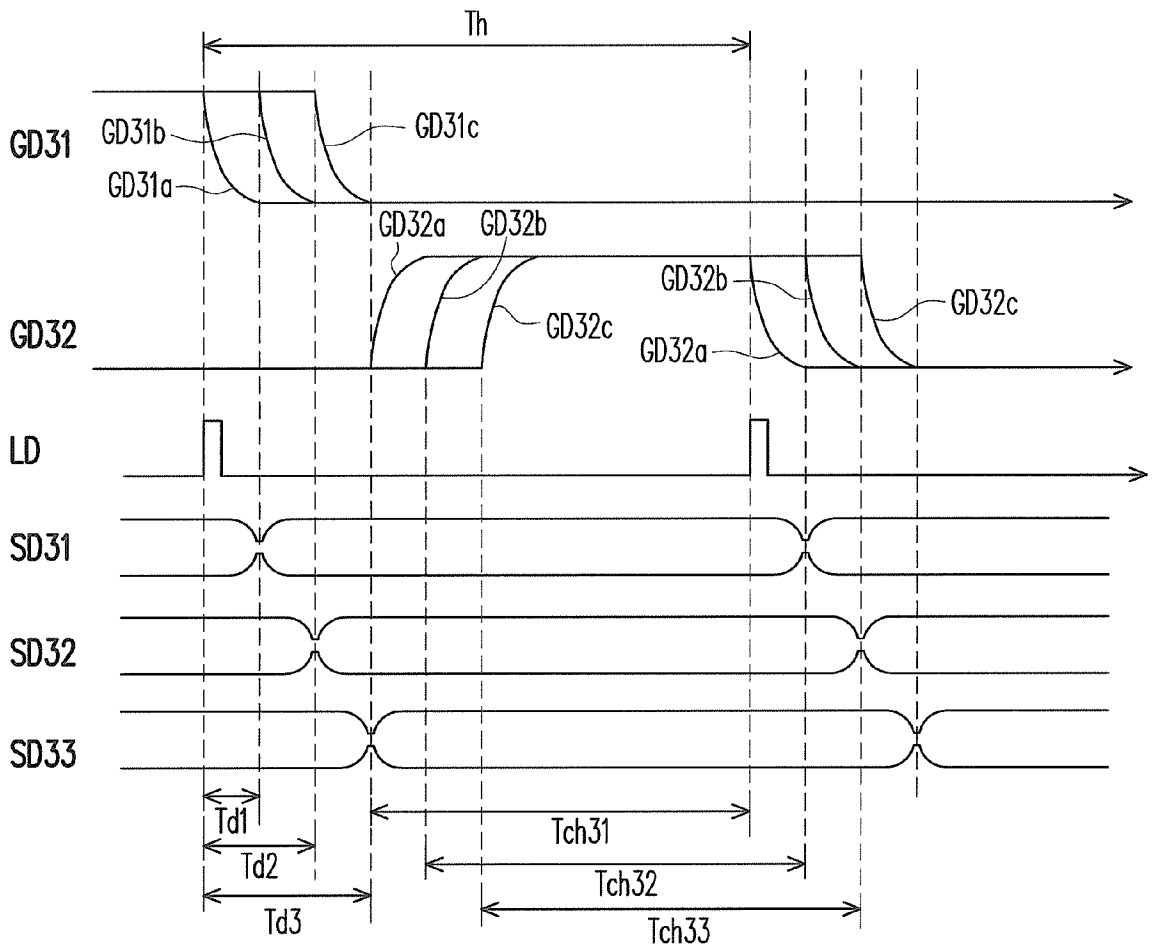
FIG. 4 is a timing diagram illustrating the signals depicted in FIG. 3 according to an embodiment of the invention.

For example (but not limited thereto), FIG. 4 is a timing diagram illustrating the signals depicted in FIG. 3 according to an embodiment of the invention. With reference to FIG. 3 and FIG. 4, the gate driver apparatuses 320_1 and 320_2 output gate driving signals to the gate lines GD31, GD32 and GD33. RC loads (e.g., equivalent circuits of the gate lines GD31, GD32 and GD33 depicted in FIG. 3) of the gate lines cause transmission delay to the gate driving signals. In FIG. 3, resistor symbols are used to represent equivalent resistors (or parasitic resistors) of the gate lines, and capacitor symbols are used to represent equivalent capacitors (or parasitic capacitors) of the gate lines. The parasitic resistors and the parasitic capacitors on the gate lines form the RC loads which cause delay to signal transmission. For example, due to the transmission delay caused by the RC load corresponding to the gate line GD31, gate driving signals GD31*a*, GD31*b* and GD31*c* received by the pixel units P11, P12 and P13 have different delay times. The delay time of each of the gate driving signals GD31*a*, GD31*b* and GD31*c* correspond to a distance from each of the pixel units P11, P12 and P13 to the gate driver apparatus 320_1. Similarly, due to the transmission delay caused by the RC load corresponding to the gate line GD32, gate driving signals GD32*a*, GD32*b* and GD32*c* received by the pixel units P21, P22 and P23 have different delay times. As the size of the display panel 340 is increased, the delay effect of the gate lines become obvious, and a position with the maximum distance to the gate driver has the most serious delay effect.

The delay control circuit 331 may control the driving channels 332_1, 332_2 and 332_3 to change the delay time of each of the source driving signals within the same horizontal scanning period Th. The horizontal scanning period Th may also be referred to as a period of a horizontal line or a scan line. The delay time of each of the source driving signals corresponds to the distance from each of the source lines SD31, SD32 and SD33 to the gate driver apparatus (e.g., the gate driver apparatus 320_1 or 320_2), where the greater the distance, the longer the delay time. The delay times of the source driving signals are different. For example (but not limited thereto), the delay time of the source driving signal transmitted to the source line SD31 by the driving channel 332_1 may be set as Td1, the delay time of the source driving signal transmitted to the source line SD32 by the driving channel 332_2 may be set as Td2, and the delay time of the source driving signal transmitted to the source line SD33 by the driving channel 332_3 may be set as Td3. The delay times Td1, Td2 and Td3 of the source driving signals are different from one another.

Figure 2:
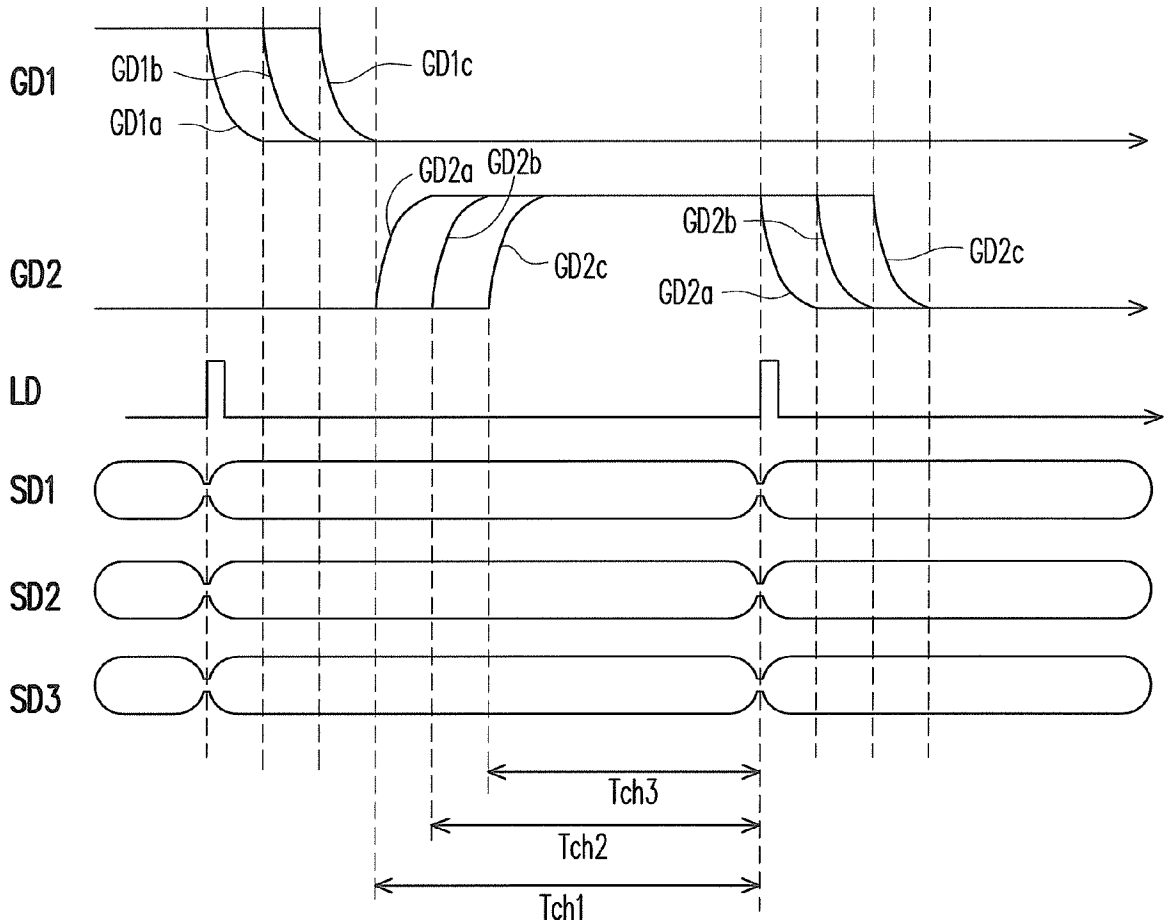
FIG. 2 (RELATED ART)
FIG. 2 is a timing diagram illustrating the signals depicted in FIG. 1.

For the same gate line (e.g., the gate line GD2), an effective charging time of the pixel unit P21 is Tch31, an effective charging time of the pixel unit P22 is Tch32, and an effective charging time of the pixel unit P23 is Tch33. According to FIG. 4, since the source driving signals output by the different driving channels 332_1, 332_2 and 332_3 have the different delay times Td1, Td2 and Td3 within the same horizontal scanning period Th, the effective charging times of the pixel units may be increased. For example (but not limited thereto), comparing FIG. 2 with FIG. 4, if it is assumed that the effective charging time Tch31 of the source driving signal of the source line SD31 illustrated in FIG. 4 is approximately equal to the effective charging time Tch1 of the source driving signal of the source line SD1 illustrated in FIG. 2, the effective charging time Tch32 of the source driving signal of the source line SD32 illustrated in FIG. 4 is greater than the effective charging time Tch2 of the source driving signal of the source line SD2 illustrated in FIG. 2, and the effective charging time Tch33 of the source driving signal of the source line SD33 illustrated in FIG. 4 is greater than the effective charging time Tch3 of the source driving signal of the source line SD3 illustrated in FIG. 2. As the effective charging time is increased, the issue of insufficiently charging a pixel unit can be improved.

The source driver apparatus 330_2 depicted in FIG. 3 may be derived with reference to the description related to the source driver apparatus 330_1. In some embodiments, the delay time of any one of the source driving signals output by the source driver apparatus 330_1 is smaller than the delay time of any one of the source driving signals output by the source driver apparatus 330_2.

Figure 5:
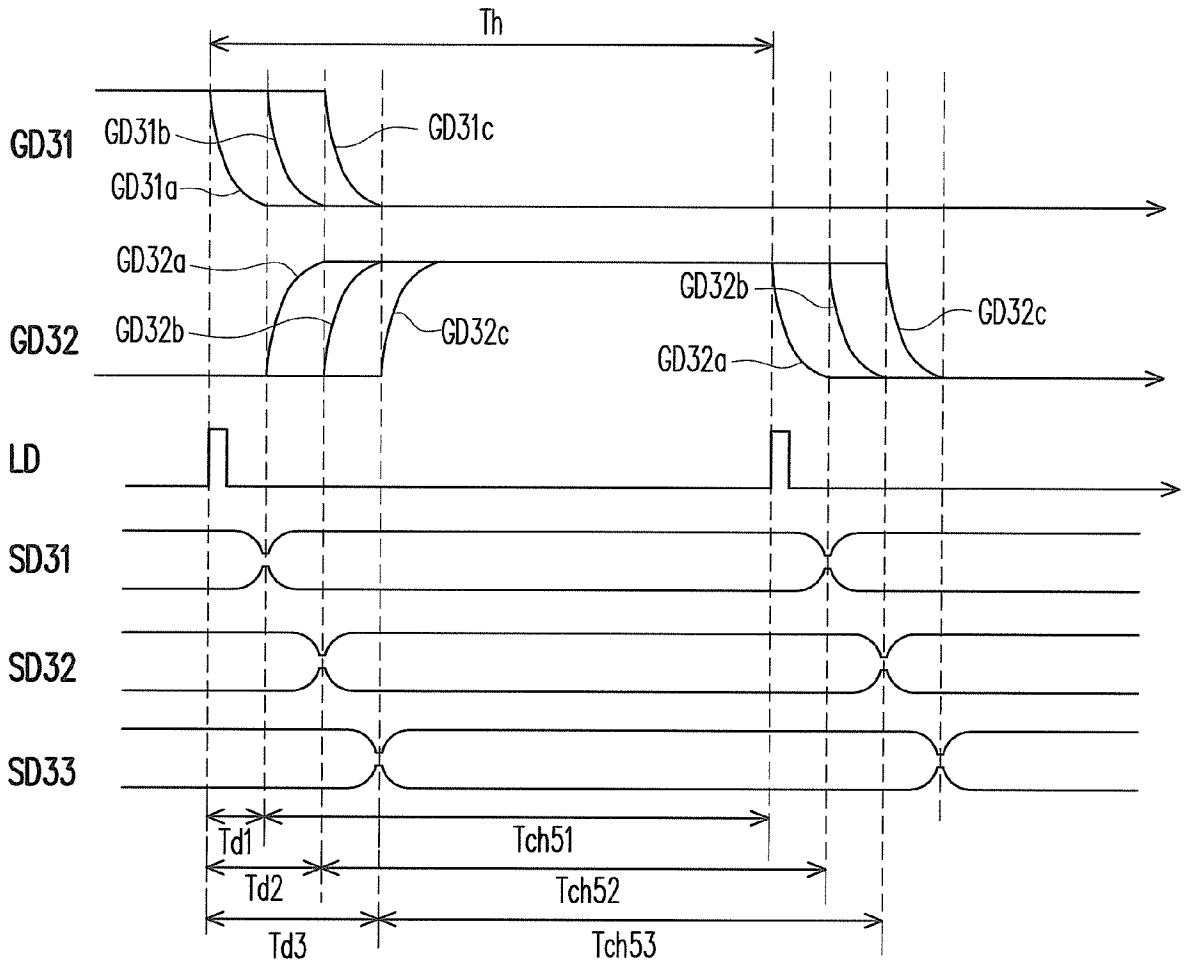
FIG. 5 is a timing diagram illustrating the signals depicted in FIG. 3 according to another embodiment of the invention.

FIG. 5 is a timing diagram illustrating the signals depicted in FIG. 3 according to another embodiment of the invention. The embodiment illustrated in FIG. 5 may be derived with reference to the description related to the embodiment illustrated in FIG. 4. In comparison with the embodiment illustrated in FIG. 4, pulse widths of the gate driving signals of the gate lines illustrated in FIG. 5 may be increased. The timing controller 310 provides an output enable signal OE to the gate driver apparatuses 320_1 and 320_2 through a control bus to control the pulse widths of the gate driving signals output by the gate driver apparatuses 320_1 and 320_2.

With reference to FIG. 3 and FIG. 5. The delay control circuit 331 may control the driving channels 332_1, 332_2 and 332_3 to change the delay times of the source driving signals of the source lines SD31, SD32 and SD33 within the same horizontal scanning period Th. The delay time of each of the source driving signals corresponds to distance from each of the source lines SD31, SD32 and SD33 to the gate driver apparatus (e.g., the gate driver apparatus 320_1 or 320_2). For example (but not limited thereto), the delay time of the source driving signal transmitted to the source line SD31 by the driving channel 332_1 may be set as Td1, the delay time of the source driving signal transmitted to the source line SD32 by the driving channel 332_2 may be set as Td2, and the delay time of the source driving signal transmitted to the source line SD33 by the driving channel 332_3 may be set as Td3.

For the same gate line (e.g., the gate line GD2), an effective charging time of the pixel unit P21 is Tch51, an effective charging time of the pixel unit P22 is Tch52, and an effective charging time of the pixel unit P23 is Tch53. Comparing FIG. 4 with FIG. 5, if it is assumed that the horizontal scanning period Th illustrated in FIG. 4 is approximately equal to the horizontal scanning period Th illustrated in FIG. 5, the effective charging time Tch51 of the source driving signal of the source line SD31 illustrated in FIG. 5 is greater than the effective charging time Tch31 of the source driving signal of the source line SD31 illustrated in FIG. 4, the effective charging time Tch52 of the source driving signal of the source line SD32 illustrated in FIG. 5 is greater than effective charging time Tch32 of the source driving signal of the source line SD32 illustrated in FIG. 4, and the effective charging time Tch53 FIG. 5 of the source driving signal of the source line SD33 illustrated in FIG. 4 is greater than the effective charging time Tch33 of the source driving signal of the source line SD33. As the effective charging time is increased, the issue of insufficiently charging a pixel unit can be improved.

In the embodiments described above, the different source driving signals output by the driving channels have the different delay times, but in any way, the invention is not limited to the illustrated embodiments. In some other embodiments, the driving channels 332_1, 332_2, 332_3 and the other driving channels illustrated in FIG. 3 may be grouped into a plurality of channel groups. The delay times of the source driving signals output by the driving channels belonging to the same channel group are the same, and the delay times of the source driving signals output by the driving channels belonging to the different channel groups are different from one another. For example (but not limited thereto), if it is assumed that the driving channels 332_1 and 332_2 belong to a first channel group, and the driving channel 332_3 belongs to a second channel group, the delay time of the source driving signal output by the driving channel 332_1 may be equal to the delay time of the source driving signal output by the driving channel 332_2, and the delay time of the source driving signal output by the driving channel 332_3 is different from the delay times of the source driving signals output by the driving channels 332_1 and 332_2.

Figure 6:
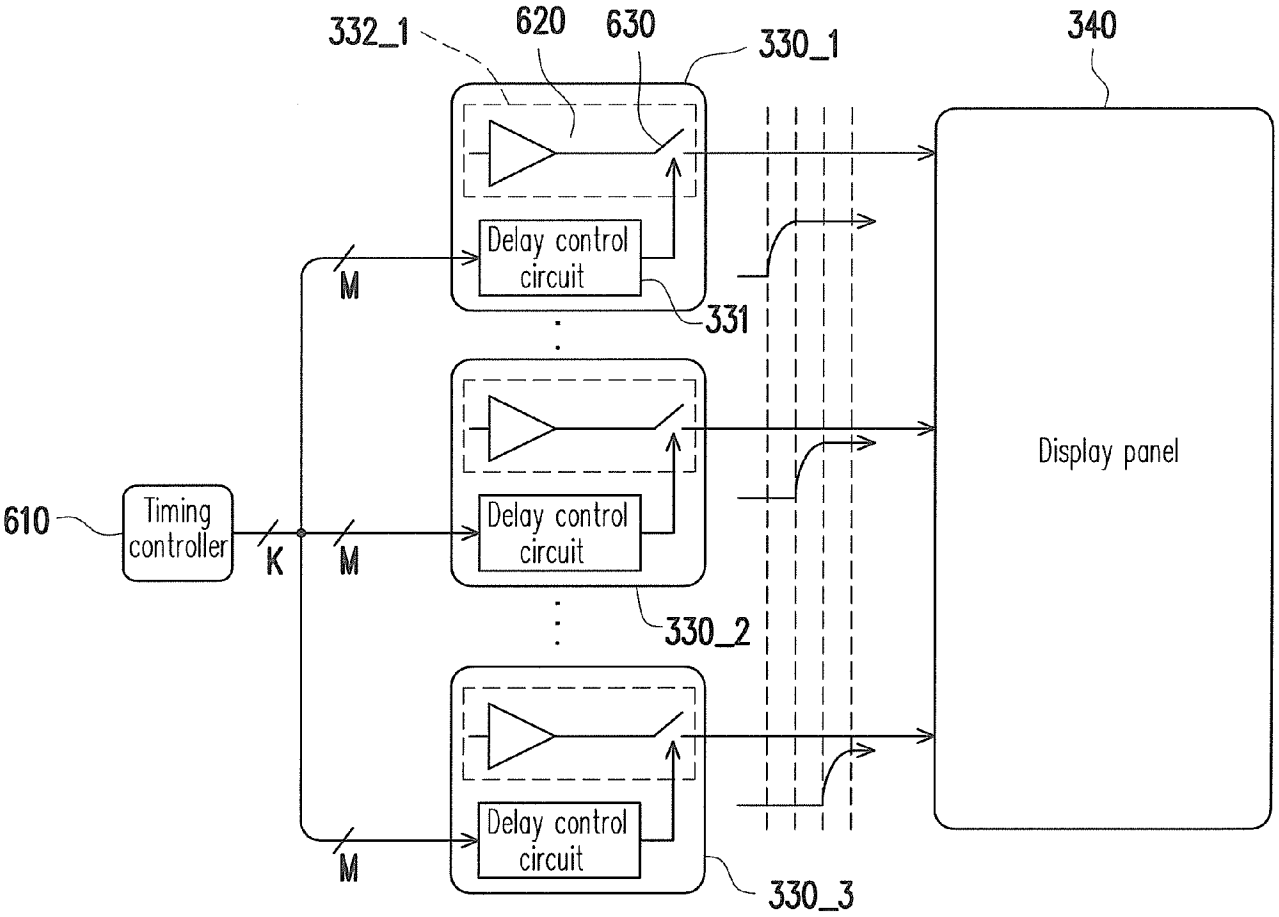
FIG. 6 is a schematic circuit block diagram illustrating the display apparatus depicted in FIG. 3 according to an embodiment of the invention.

FIG. 6 is a schematic circuit block diagram illustrating the display apparatus 300 depicted in FIG. 3 according to an embodiment of the invention. The display apparatus 300 includes an external controller (e.g. timing controller 610), one or more source driver apparatus (e.g., the source driver apparatuses 330_1, 330_2 and 330_3 depicted in FIG. 1) and the display panel 340. In accordance with product design requirements, the timing controller 610 may include a timing controller, micro-controller or other control circuits.

Hereinafter, the source driver apparatus 330_1 will be described as an example. The other source driver apparatuses (e.g., the source driver apparatuses 330_2 and 330_3) may be derived with reference to the description related to the source driver apparatus 330_1 and thus, will not be repeatedly described.

The source driver apparatus 330_1 includes a delay control circuit 331 and a plurality of driving channels (e.g., the driving channel 332_1). The other driving channels (e.g., the driving channels 332_2 and 332_3 depicted in FIG. 3) may be derived with reference to the description related to the driving channel 332_1 and thus, will not be repeatedly described. The driving channel 332_1 includes an output buffer 620 and an output switch 630. A first terminal of the output switch 630 is coupled to an output terminal of the output buffer 620. A second terminal of the output switch 630 is coupled to a corresponding source line (e.g., the source line SD31 depicted in FIG. 3) among the source lines of the display panel 340.

The delay control circuit 331 is configured to couple the timing controller 610. Based on the control of the timing controller 610, the delay control circuit 331 may determine delay times (e.g., the delay time Td1 depicted in FIGS. 4 and 5) of the source driving signals output by the driving channels (e.g., the driving channel 332_1) in the source driver apparatus 330_1. Taking the circuit illustrated in FIG. 6 as an example, the delay control circuit 331 may control a turn-on timing of the output switch 630 to change the delay time of the source driving signal (e.g., the delay time Td1 depicted in FIGS. 4 and 5) of the corresponding source line (e.g., the source line SD31 depicted in FIG. 3).

The source driver apparatuses 330_2 and 330_3 illustrated in FIG. 6 may be derived with reference to the description related to the source driver apparatus 330_1. Based on the control of the timing controller 610, the delay time of any one of the source driving signals output by the source driver apparatus 330_1 is smaller than the delay time of any one of the source driving signals output by the source driver apparatus 330_2, and the delay time of any one of the source driving signals output by the source driver apparatus 330_2 is smaller than the delay time of any one of the source driving signals output by the source driver apparatus source driver apparatus 330_3. Namely, the delay time of each of the source driving signals corresponds to a distance from the source line to a distance to the gate driver apparatus, where the greater the distance, the longer the delay time.

In the embodiments described above, the delay control circuit 331 of the source driver apparatus 330_1 is controlled by the timing controller 610 to determine the delay times (e.g., the delay times Td1, Td2 and Td3 depicted in FIGS. 4 and 5) of the driving channels (e.g., the driving channels 332_1, 332_2 and 332_3 depicted in FIG. 3), but in any way, the invention is not limited to the illustrated embodiments. For example, in some other embodiments, the delay control circuit 331 may be capable of self-detecting and dynamically determining the delay times (e.g., the delay times Td1, Td2 and Td3 depicted in FIGS. 4 and 5) of the driving channels (e.g., the driving channels 332_1, 332_2 and 332_3 depicted in FIG. 3) according to the detection result.

Figure 7:
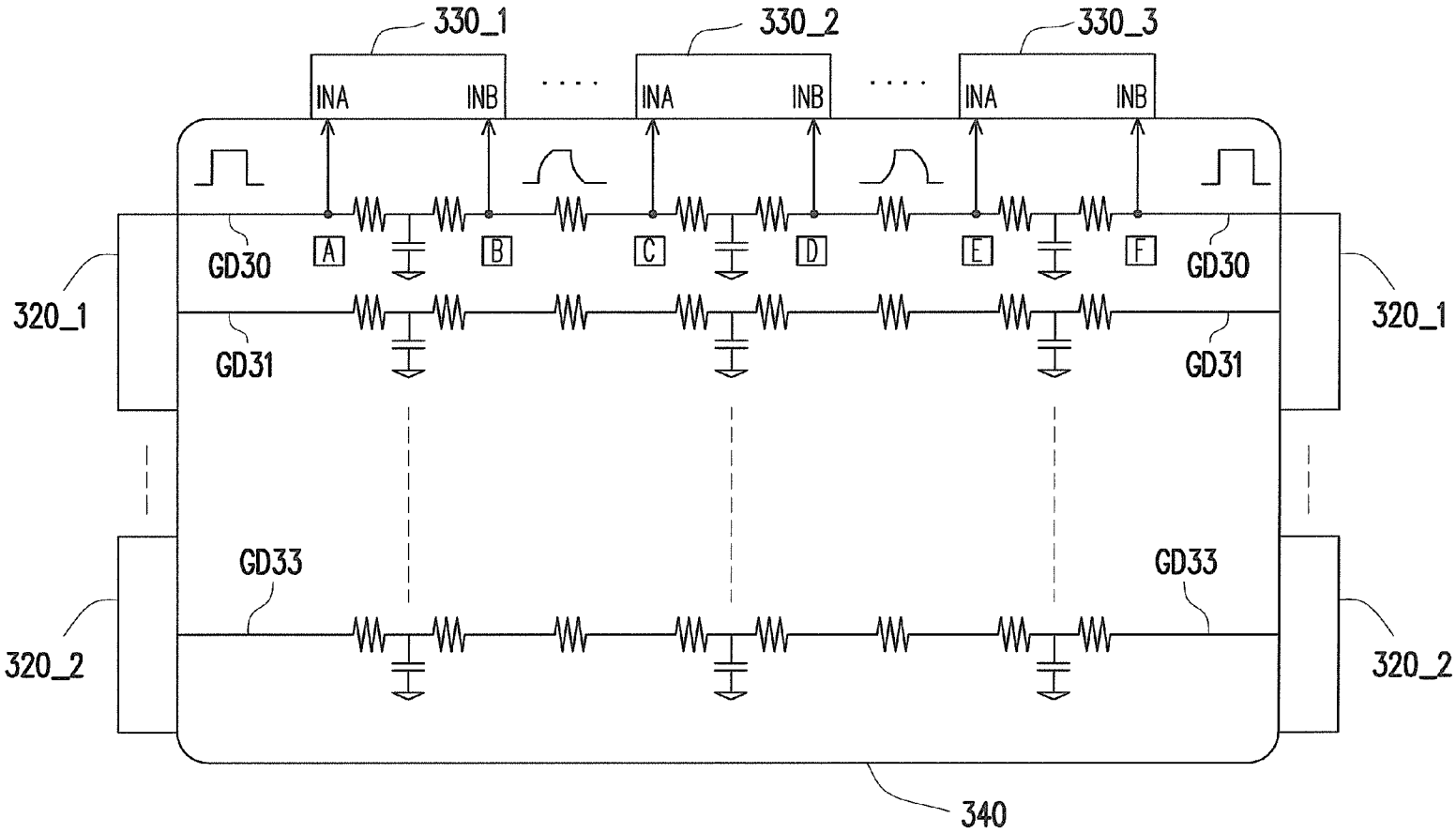
FIG. 7 is a schematic circuit block diagram illustrating the display apparatus depicted in FIG. 3 according to another embodiment of the invention.

FIG. 7 is a schematic circuit block diagram illustrating the display apparatus 300 depicted in FIG. 3 according to another embodiment of the invention. In the embodiment illustrated in FIG. 7, a dummy gate line GD30 is further disposed in the display panel 340. The gate driver apparatuses 320_1 and 320_2 output gate driving signals (i.e., scan signals) to the dummy gate line GD30, gate lines GD31, GD32 and GD33. Being different from the gate lines GD31, GD32 and GD33, the dummy gate line GD30 is not connected to any pixel unit. Each of the source driver apparatuses 330_1, 330_2 and 330_3 has detection terminals INA and INB. The detection terminals INA and INB of each of the source driver apparatuses 330_1, 330_2 and 330_3 are respectively coupled to different positions on the dummy gate line GD30 in the display panel 340 to detect a timing of the gate driving signal output by the gate driver apparatus 320_1 at different positions. For example, the detection terminals INA and INB of the source driver apparatus 330_1 are respectively coupled to a position A and a position B of the dummy gate line GD30, the detection terminals INA and INB of the source driver apparatus 330_2 are respectively coupled to a position C and a position D of the dummy gate line GD30, and the detection terminals INA and INB of the source driver apparatus 330_3 are respectively coupled to a position E and a position F of the dummy gate line GD30. According to the detection result, the source driver apparatuses 330_1, 330_2 and 330_3 may dynamically determine the delay times of the source driving signals (which may be derived with reference to the description related to the delay times Td1, Td2 and Td3 depicted in FIGS. 4 and 5).

Figure 8:
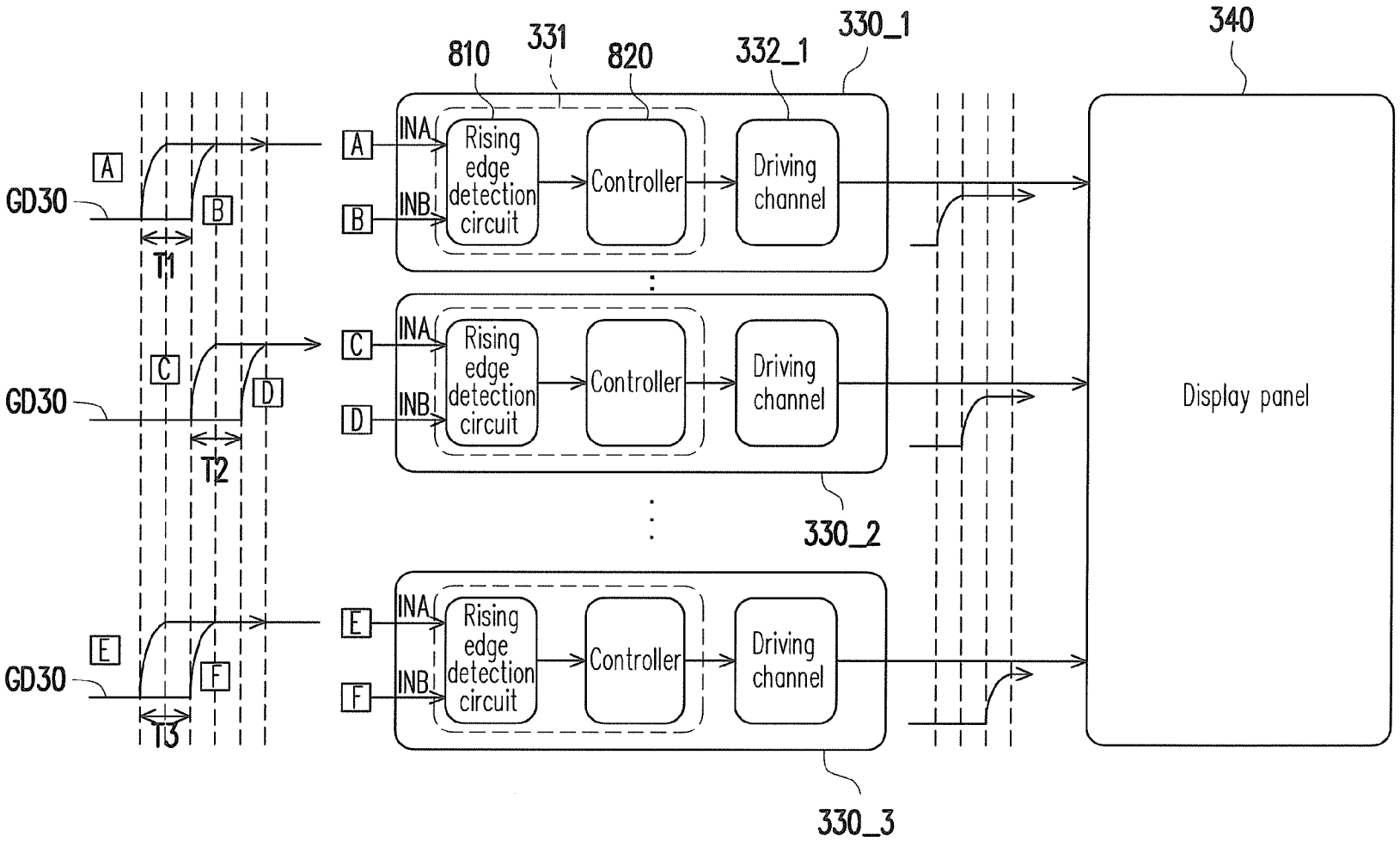
FIG. 8 is a schematic circuit block diagram illustrating the source driver apparatus depicted in FIG. 7 according to an embodiment of the invention.

FIG. 8 is a schematic circuit block diagram illustrating the source driver apparatus depicted in FIG. 7 according to an embodiment of the invention. Hereinafter, the source driver apparatus 330_1 will be described as an example. The other source driver apparatuses (e.g., the source driver apparatuses 330_2 and 330_3) may be derived with reference to the description related to the source driver apparatus 330_1 and thus, will not be repeatedly described.

The source driver apparatus 330_1 includes a delay control circuit 331 and a plurality of driving channels (e.g., the driving channel 332_1). The other driving channels (e.g., the driving channels 332_2 and 332_3 depicted in FIG. 3) may be derived with reference to the description related to the driving channel 332_1 and thus, will not be repeatedly described. An output terminal of the driving channel 332_1 is coupled to a corresponding source line (e.g., the source line SD31 depicted in FIG. 3) among the source lines of the display panel 340.

A first detection terminal of the delay control circuit 331 is coupled to the position A of the dummy gate line GD30 of the display panel 340 through the detection terminal INA of the source driver apparatus 330_1, and a second detection terminal of the delay control circuit 331 is coupled to the position B of the dummy gate line GD30 through the detection terminal INB of the source driver apparatus 330_1. The delay control circuit 331 may detect the timing of the gate driving signal at the position A and the position B. The delay control circuit 331 may determine by itself the delay times (e.g., the delay times Td1, Td2 and Td3 depicted in FIGS. 4 and 5) of the source driving signals output by the source driver apparatus 330_1 according to the timing (or a time difference T1) of the gate driving signal at the position A and the position B.

In the same way, a first detection terminal and a second detection terminal of the of the delay control circuit of the source driver apparatus 330_2 are coupled to the position C and the position D of the dummy gate line GD30 respectively through the detection terminal INA and the detection terminal INB of the source driver apparatus 330_2, and a first detection terminal and a second detection terminal of the source driver apparatus 330_3 are coupled to the position E and the position F of the dummy gate line GD30 respectively through the detection terminal INA and the detection terminal INB of the source driver apparatus 330_3. The delay control circuit of the source driver apparatus 330_2 may detect the timing (or a time difference T2) of the gate driving signal at the position C and the position D and determine by itself the delay times of the source driving signals output by the source driver apparatus 330_2. The delay control circuit of the source driver apparatus 330_3 may detect the timing (or a time difference T3) of the gate driving signal at the position E and the position F and determine by itself the delay times of the source driving signals output by the source driver apparatus source driver apparatus 330_3.

In the embodiment illustrated in FIG. 8, the delay control circuit 331 includes a rising edge detection circuit 810 and a controller 820. The rising edge detection circuit 810 is coupled to the first detection terminal of the delay control circuit 331 to detect a rising edge timing of the gate driving signal at the position A to obtain a first time point. The rising edge detection circuit 810 is coupled to the second detection terminal of the delay control circuit 331 to detect a rising edge timing of the gate driving signal at the position B to obtain a second time point. The controller 820 is coupled to the rising edge detection circuit 810 and the driving channels (e.g., the driving channel 332_1). The controller 820 is configured to calculate the time difference T1 between the first time point and the second time point to determine the delay time of the source driving signal (which may be derived with reference to the description related to the delay times Td1, Td2 and Td3 depicted in FIGS. 4 and 5) of each of the driving channels according to the time difference T1.

An operating method of a source driver apparatus is described hereinafter. The operating method includes the following steps. A plurality of source driving signals is output to a plurality of source lines of a display panel by a plurality of driving channels in a one-to-one manner. The driving channels are controlled by a delay control circuit to change delay times of the source driving signals within the same horizontal scanning period. Therein, the delay times of the source driving signals respectively correspond to distances from the source lines to a gate driver apparatus of the display panel.

In some embodiments, the delay times of the source driving signals are different from one another. In some other embodiments, the driving channels are grouped into a plurality of channel groups, wherein the delay times of the source driving signals of the driving channels belonging to the same channel group are the same with one another, while the delay times of the source driving signals of the driving channels belonging to different channel groups are different from one another.

In some embodiments, the delay time of any one of the source driving signals output by one source driver apparatus (i.e., a first source driver apparatus) is smaller than the delay time of any one of the source driving signals output by another source driver apparatus (i.e., a second source driver apparatus) in the display panel. A distance from a source line connected with the first source driver apparatus to the gate driver apparatus is smaller than a distance from a source line connected with the second source driver apparatus to the gate driver apparatus.

In some embodiments, the delay control circuit of the source driver apparatus determines the delay times of the source driving signals based on the control of an external controller (e.g., a timing controller or any other control circuit).

In some other embodiments, the delay control circuit of the source driver apparatus may detect a timing of each gate driving signal at a first position and a second position on a dummy gate line of the display panel. According to the timing of each gate driving signal at the first position and the second position, the delay control circuit can determine by itself the delay times of the source driving signals. For example (but not limited thereto), the delay control circuit may detect a rising edge timing of the gate driving signal at the first position to obtain a first time point and detect a rising edge timing of the gate driving signal at the second position to obtain a second time point . . . . The delay control circuit may calculate a time difference between the first time point and the second time point and dynamically determine the delay times of the source driving signals of the driving channels according to the time difference.

To summarize, in the source driver apparatus and the operating method thereof provided by the embodiments of the invention, the source driving signals output by different driving channels within the same horizontal scanning period have different delay times (e.g., the delay times Td1, Td2 and Td3 depicted in FIGS. 4 and 5), so as to increase the effective charging times (e.g., the effective charging times Tch31, Tch32 and Tch33 depicted in FIG. 4, or the effective charging times Tch51, Tch52 and Tch53 depicted in FIG. 5) of the pixel units.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A source driver apparatus for driving a plurality of source lines of a display panel, the display panel further comprising a gate driver apparatus, the source driver apparatus comprising:

a plurality of driving channels, configured to output a plurality of source driving signals; and a delay control circuit, configured to control the driving channels to change delay times of the source driving signals within a period, such that the delay times of the source driving signals correspond to distances from the source lines to the gate driver apparatus, wherein a first detection terminal and a second detection terminal of the delay control circuit are respectively coupled to a first position and a second position on a dummy gate line of the display panel to detect a timing of a gate driving signal at the first position and the second position, and the delay control circuit determines the delay times of the source driving signals according to the timing of the gate driving signal at the first position and the second position.

2. The source driver apparatus according to claim 1, wherein the delay times of the source driving signals are different from one another.

3. The source driver apparatus according to claim 1, wherein the period is a horizontal scanning period.

4. The source driver apparatus according to claim 1, wherein the driving channels are grouped into a plurality of channel groups, the delay times of the source driving signals of the driving channels belong to the same channel group are equal to one another, and the delay times of the source driving signals of the driving channels belong to different channel groups are the different from one another.

5. The source driver apparatus according to claim 1, wherein the display panel is further coupled to a second source driver apparatus, and the delay time of any one of the source driving signals output by the source driver apparatus is smaller than the delay time of any one source driving signal output by the second source driver apparatus.

6. The source driver apparatus according to claim 1, wherein one of the driving channels comprises:

an output buffer; and an output switch, having a first terminal coupled to an output terminal of the output buffer, and a second terminal coupled to a corresponding source line among the source lines, wherein the delay control circuit controls a turn-on timing of the output switch to change the delay time of the source driving signal of the corresponding source line.

7. The source driver apparatus according to claim 1, wherein the delay control circuit is configured to couple an external controller and determine the delay times of the source driving signals based on the control of the external controller.

8. The source driver apparatus according to claim 7, wherein the external controller comprises a timing controller.

9. The source driver apparatus according to claim 1, wherein the delay control circuit comprises:

a rising edge detection circuit, coupled to the first detection terminal of the delay control circuit to detect a rising edge timing of the gate driving signal at the first position to obtain a first time point, and coupled to the second detection terminal of the delay control circuit to detect a rising edge timing of the gate driving signal at the second position to obtain a second time point; and a controller, coupled to the rising edge detection circuit and the driving channels, and configured to calculate a time difference between the first time point and the second time point and determine the delay times of the source driving signals of the driving channels according to the time difference.

10. An operating method of a source driver apparatus for driving a plurality of source lines of a display panel, the display panel further comprising a gate driver apparatus, the operating method comprising:

outputting a plurality of source driving signals for driving the plurality of source lines; and configuring delay times of the source driving signals within a period, such that the delay times of the source driving signals correspond to distances from the source lines to the gate driver apparatus, wherein the step of controlling the driving channels by the delay control circuit to change the delay times of the source driving signals comprises:

detecting a timing of a gate driving signal at a first position and a second position on a dummy gate line of the display panel by the delay control circuit; and determining the delay times of the source driving signals according to the timing of the gate driving signal at the first position and the second position by the delay control circuit.

11. The operating method according to claim 10, wherein the delay times of the source driving signals are different from one another.

12. The operating method according to claim 10, wherein the period is a horizontal scanning period.

13. The operating method according to claim 10, wherein the driving channels are grouped into a plurality of channel groups, the delay times of the source driving signals of the driving channels belong to the same channel group are equal to one another, and the delay times of the source driving signals of the driving channels belong to different channel groups are the different from one another.

14. The operating method according to claim 10, wherein the delay time of any one of the source driving signals output by the source driver apparatus is smaller than the delay time of any one source driving signal output by a second source driver apparatus.

15. The operating method according to claim 10, wherein the step of controlling the driving channels by the delay control circuit to change the delay times of the source driving signals comprises:

determining the delay times of the source driving signals by the delay control circuit based on the control of an external controller.

16. The operating method according to claim 15, wherein the external controller comprises a timing controller.

17. The operating method according to claim 11, wherein the step of controlling the driving channels by the delay control circuit to change the delay times of the source driving signals further comprises:

detecting a rising edge timing of the gate driving signal at the first position to obtain a first time point by the delay control circuit;

detecting a rising edge timing of the gate driving signal at the second position to obtain a second time point by the delay control circuit;

calculating a time difference between the first time point and the second time point by the delay control circuit; and determining the delay times of the source driving signals of the driving channels according to the time difference by the delay control circuit.

* * * * *